US006415554B1

(12) United States Patent
Stevenson et al.

(10) Patent No.: US 6,415,554 B1
(45) Date of Patent: Jul. 9, 2002

(54) PAINT BOOTH FRAME ASSEMBLY AND METHOD OF CONSTRUCTING A PAINT BOOTH

(75) Inventors: Walter Stevenson, Farmington Hills; David John Cole, Canton, both of MI (US)

(73) Assignee: Durr Industries, Inc., Plymouth, MI (US)

( * ) Notice: Subject to any disclaimer, the term of this patent is extended or adjusted under 35 U.S.C. 154(b) by 47 days.

(21) Appl. No.: 09/728,337

(22) Filed: Dec. 1, 2000

(51) Int. Cl.[7] ..... A47F 10/00

(52) U.S. Cl. ..... 52/36.1; 29/467; 248/676; 248/317

(58) Field of Search ..... 52/653.1, 650.3, 52/648.1, 696, 634, 636

(56) References Cited

U.S. PATENT DOCUMENTS 3,977,147 A * 8/1976 Fletcher et al. ..... 29/467
4,660,799 A * 4/1987 Butland ..... 248/317
6,266,938 B1 * 7/2001 Sheu et al. ..... 248/676

* cited by examiner

*Primary Examiner*—Carl D. Friedman
*Assistant Examiner*—Steve Varner
(74) *Attorney, Agent, or Firm*—Howard & Howard

(57) ABSTRACT

A frame assembly for supporting a paint booth that includes a paint application chamber and a reclamation tank. A plurality of frame posts is spaced apart and affixed to a base floor. Opposing support members, each having a shell, are arranged end to end in a parallel column. Each of the shells is affixed to the upper end of at least two of the frame posts. The support member includes a horizontal structural element affixed longitudinally inside the shell, and at least one vertical support element affixed to the horizontal structural element inside the shell. Each of the shells forms a section of the reclamation tank and provides support to a section of the paint application chamber allowing the paint booth to be installed independently of a building that houses the paint booth.

24 Claims, 6 Drawing Sheets

PAINT BOOTH FRAME ASSEMBLY AND METHOD OF CONSTRUCTING A PAINT BOOTH

BACKGROUND OF THE INVENTION

The subject invention relates generally to an improved method of constructing a paint application facility including the paint booth and paint reclamation tank in a production paint facility and an improved unitary truss assembly for this application.

A paint booth for use in a production facility intended to paint vehicles or other products requires extensive time and manpower to complete. Different work crews specialize in, and construct different portions of the facility. For example, one work crew specializes in constructing the paint booth and related facility, while another work crew specializes in constructing the building that houses the paint booth.

Presently, construction of the production facility begins by pouring a concrete base floor and affixing vertically oriented support columns thereto. This part of the construction is performed by the building work crew. After the support columns have been installed, the paint booth work crew installs reclamation paint tanks or a gas scrubber system that will provide structural support to the building and to the booth. The tanks must be leveled to provide evenly distributed structural support to the building, which is a difficult and labor intensive process. Once the tanks are installed, the paint booth work crew is idled while the remainder of the building is constructed, which includes constructing an operating floor around the tanks.

After the building has been completed, the paint booth work crew returns to complete construction of the paint booth. This includes building the paint application chamber over the tanks, installing an air plenum, and installing the painting equipment and other related components.

The method described above for constructing the building and the paint booth housed by the building has several significant drawbacks. First, the base floor needs to be fully installed prior to any other construction. Second, the complete reclamation tanks must be fully fabricated and ready for installation upon completion of the base floor. Third, the tanks must be fully installed prior to constructing the surrounding structures, such as other support beams and flooring. Finally, the paint booth work crew is idled by months while the building is being constructed around the tanks and the flooring cures.

Therefore, it would be desirable to devise a method for constructing a paint booth facility and a building for housing the booth that would allow for the continuous utilization of each of the work crews. It would further be desirable to construct a frame for supporting the paint booth that does not require a completed reclamation tank or scrubber system to be utilized as a significant support structure for the booth and the building.

SUMMARY OF THE INVENTION AND ADVANTAGES

The subject invention is a frame assembly for supporting a paint booth that includes paint application chamber and a reclamation tank, heated flash off equipment, miscellaneous booths and decks, etc. A plurality of frame posts are spaced apart and affixed to a base. Opposing support members, each having a shell, are arranged end to end in a parallel column. Each of the shells is affixed to an upper end of at least two of the frame posts. The support member includes a horizontal structural element affixed longitudinally inside the shell, and at least one vertical support element affixed to the horizontal structural element inside the shell. Each of the shells forms a section or wall of the reclamation tank and provides support to a section of the paint application chamber.

The frame is installed by the building work crew without the involvement of the booth work crew. The building and structural components surrounding the booth are constructed prior to installing the reclamation tanks and are affixed to the support members. Because the support members provide structural support to the booth, the paint application chamber and related components can be installed independently of the tanks. Further, the booth work crew can continuously construct the entirety of the booth without having to wait for the structures surrounding the booth to be fully installed. This allows for the booth work crew to work up to a month longer on the booth without adding any additional time to the building construction project. Still further, the support member is leveled while the frame is being constructed. Therefore, the tanks, by virtue of being attached to the support member, are also easily leveled.

In the preferred embodiment, the frame assembly of this invention is formed as a unitary truss assembly which is preferably preassembled for assembly by the building work crew and forms a component of the paint booth as now described. The unitary truss assembly includes an elongated C-shaped or frame member having a central portion and opposed leg portions extending generally perpendicular to the central portion. An elongated rectangular beam or tubular structural element is nested within the C-shaped frame member having one side face abutting one of the leg portions and an adjacent side face abutting the central portion of the frame member. A plurality of spaced support members or beams are assembled in the C-shaped shell in spaced relation each having one end face abutting a side-face of the elongated beam and an opposed face abutting the opposed leg portion of the C-shaped frame member. In the preferred embodiment, the abutting faces of the rectangular beam, the C-shaped shell or frame member and the support beams are welded together to form a unitary truss assembly which may be manufactured at a convenient remote site and shipped to the construction site. The unitary truss assembly is then supported on the poured base of the paint application facility by spaced vertical beams which are coaxially aligned with the support beams and welded to the leg portion of the C-shaped frame member. The floor joists may then be welded to the rectangular beam forming a secure structure ready to receive the paint booth. During the construction of the paint booth by the paint booth crew, the reclamation paint tank is secured to the C-shaped frame member and, in the preferred embodiment, the C-shaped frame member forms a side wall of the reclamation tank or tanks as described above.

The inventive support member and method of constructing the frame resolves the construction problems associated with the prior art method of constructing a production paint booth. The support member allows for a more efficient use of the work crews thereby shortening the amount of time required to construct the production facility. These improvements also reduce the costs associated with constructing the facility.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
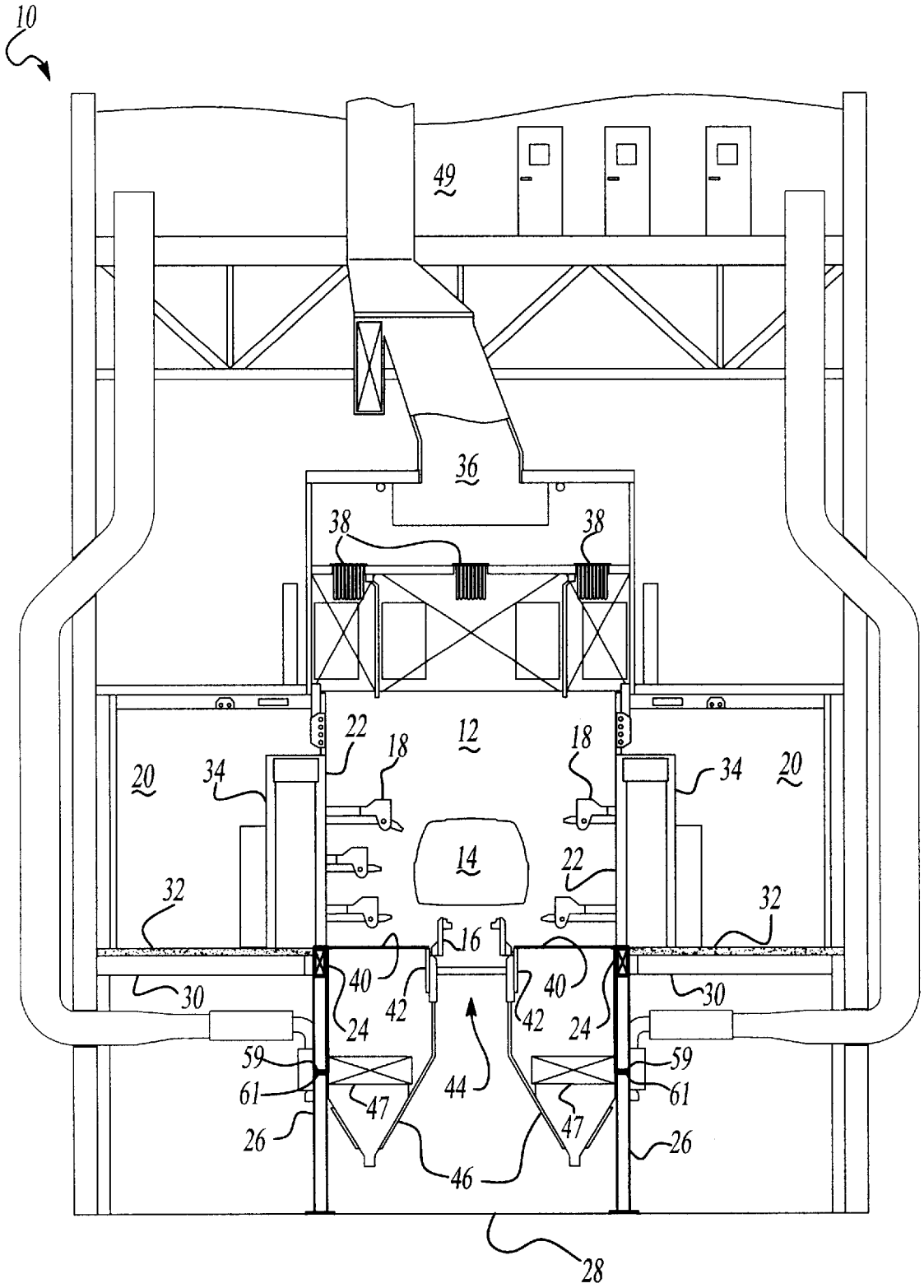
FIG. 1 is a front sectional elevation of the paint booth showing the inventive frame assembly.

Referring to FIG. 1, a cross-section of booth for applying paint is generally shown at 10. The booth includes a paint application chamber 12 wherein the paint is applied to a vehicle body 14 or other product. The chamber 12 forms an elongated room into which the bodies 14 are conveyed for painting. A conveying device 16, such as, for example a conveyor, moves the product through the application chamber 12.

Paint application equipment 18 is disposed in the application chamber 11 for applying the paint as is known in the art of production painting. The application equipment is represented as powder application equipment in the Figures. However, water and solvent based paint application equipment may be installed as desired. As will be understood by persons of ordinary skill in this art, liquid paint application systems utilize a liquid gas scrubber system including a tank 20 disclosed, for example, in U.S. Pat. No. 5,100,442. The term "reclamation tank" as used herein is intended to be generic to powder and liquid paint application systems. The chamber 12 is enclosed by opposing walls 22, which separate the chamber 12 from each of the control rooms 20. The walls 22 are supported from below by a plurality support members 24 that are arranged end to end along the entire length of the booth 10. At least two frame posts 26 are affixed beneath each of the support members 24 to support the booth 10 thereby distancing the booth 10 from a base floor 28. Preferably, the frame posts 26 are spaced approximately ten feet apart. However, the frame posts 26 may be spaced further apart, but preferably not exceeding twenty feet apart.

A plurality of horizontal support beams 30 are affixed to the support members 24 and project outwardly from the booth 10. A control room floor 32 is formed over the horizontal support beams 30 for supporting control equipment 34 associated with operating the booth 10. The floor 32 is formed from cement or an equivalent and structural caging, such as a sheet metal deck, as is known in the art of industrial building construction.

An air supply plenum 36 is affixed above the booth 10 to provide fresh air to the application chamber 12. Filters 38 are disposed within the plenum 36 to remove impurities from the fresh air that would otherwise result in paint defects on the vehicle body 14. The fresh air provides a down draft to the chamber 12 to force paint particles that have not adhered to the vehicle body 14 downward and out of the chamber 12. In a powder paint application process, the paint particles will be circulated through a reclamation system (not shown). In a liquid paint application process, the paint particles will be captured by a chemically treated water bath (not shown) and subsequently filtered.

A plurality of grates 40 form the floor of the application chamber 12. The grates 40 are supported on one end by a conveyor beam 42 and the other end by the support members 24. Each conveyor beam 42 is affixed to the support member 24 by at least two conveyor support beams 43. The conveying device 16 operates in a channel 44 between parallel conveyor support beams 42. The grates 40 allow air from the plenum 36 and paint particles that have not adhered to the body 14 to pass therethrough and into a plurality of reclamation hoppers 46 disposed beneath the chamber 12. FIG. 1 shows a powder reclamation hopper 46 disposed beneath each of the grates 40 thereby enclosing the bottom of the booth 10. Air is drawn through a filter 47 disposed in each hopper and routed through a filter house 49 before being returned to the plenum 36. The filters 47 are periodically pulsed to prevent powder paint particles from accumulating and fouling the filters 47.

Figure 2:
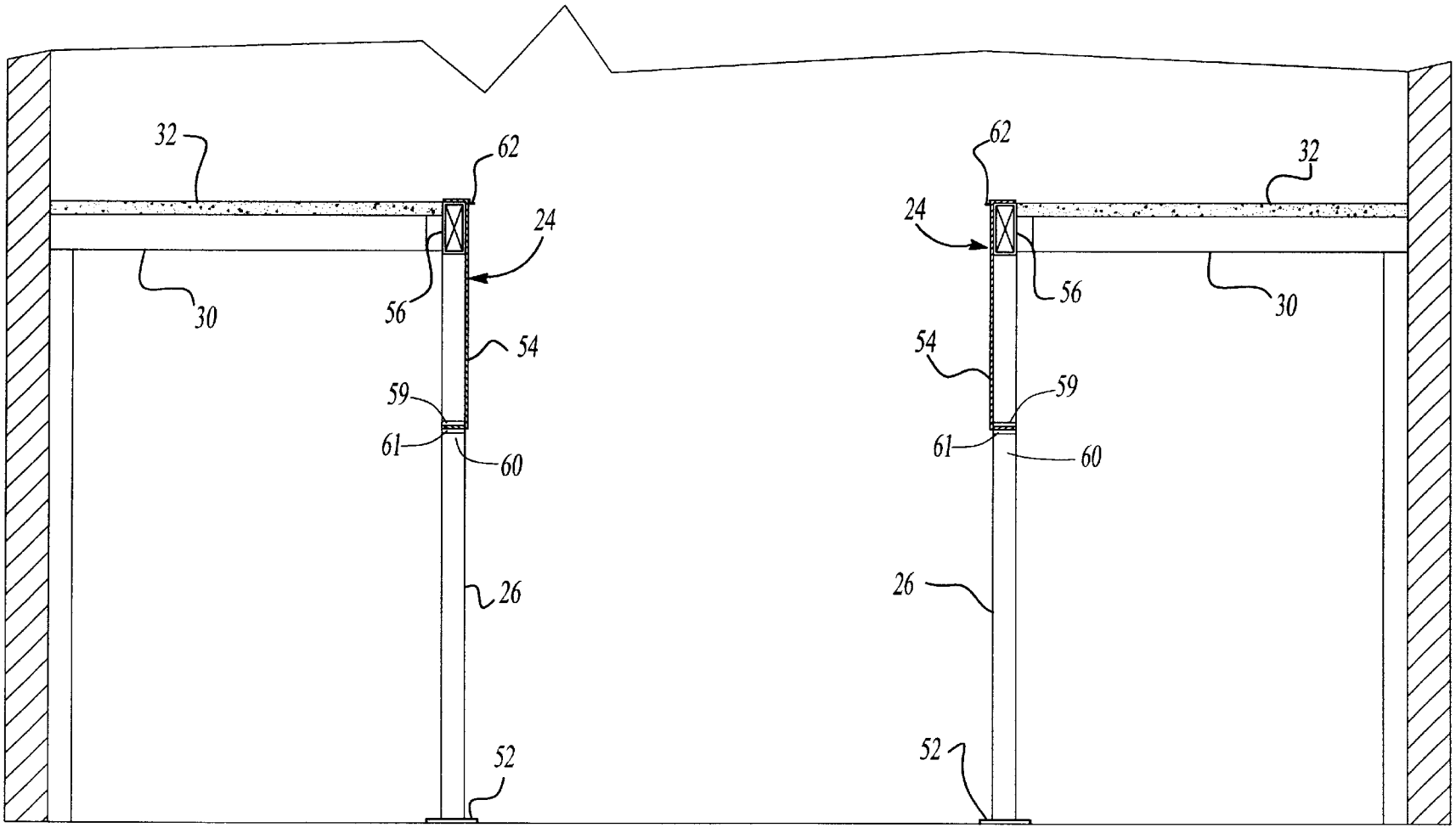
FIG. 2 is a sectional elevation of the inventive frame assembly.
Figure 3:
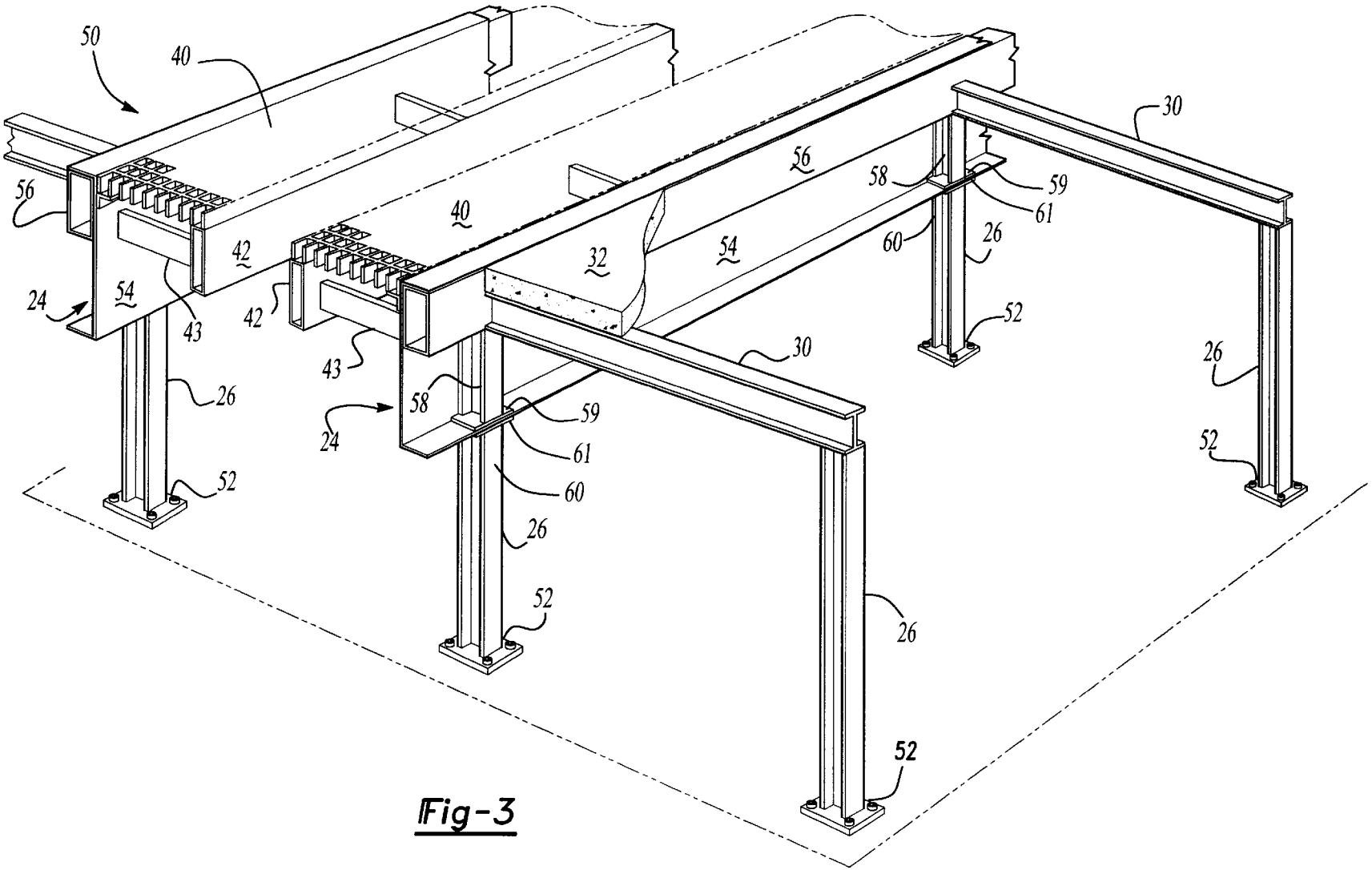
FIG. 3 is a perspective view of the inventive frame assembly.

A frame 50 for supporting the paint booth 10 is shown in FIGS. 2 and 3. Each support member 24 includes a shell 54 forming a C-shaped section. A horizontal structural element 56 is affixed longitudinally inside the shell 54 and is formed from a tube. The horizontal structural element 56 provides longitudinal support to the shell 54. Further, the horizontal structural element 56 provides a surface to weld the horizontal support beams 30 to as will be explained further below. At least one vertical support element 58 is affixed beneath the horizontal structural element 56 inside the shell 54. Each vertical support element 58 is formed from an I-beam and provides structural support to the shell 54 in the vertical direction. An I-beam plate 59 is affixed to the bottom of the vertical structural element 56 to provide support to the shell 54. Thus, the vertical support element 58 prevents the shell 54 from buckling under the weight of the booth 10.

Figure 5:
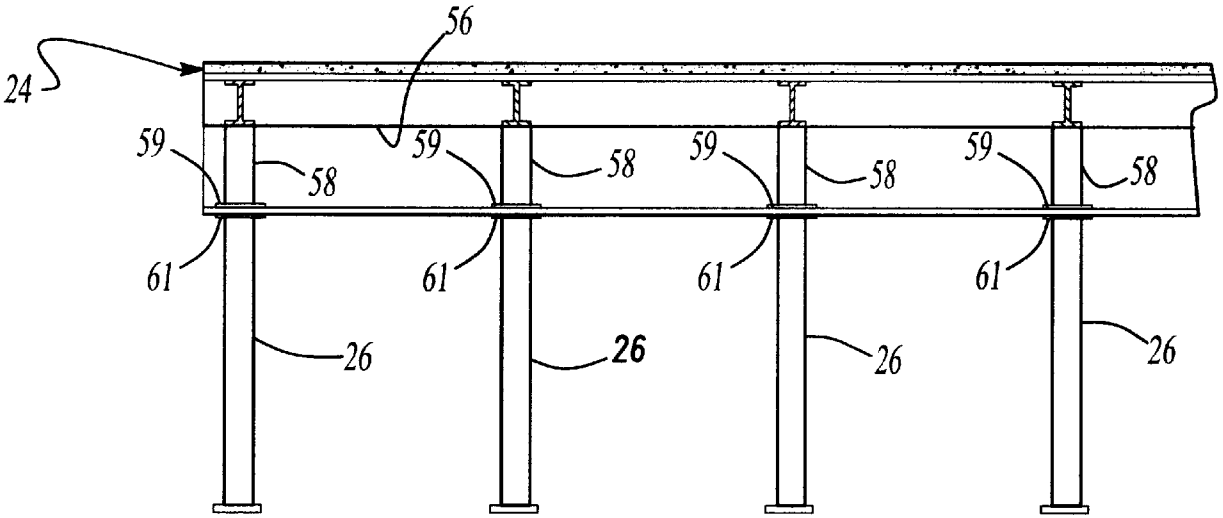
FIG. 5 is a side view of the inventive frame assembly.

During construction of the building that houses the booth 10, opposing shells 54 are arranged end to end forming horizontal, parallel beams. Each shell 54 is affixed to an upper end 60 of at least two of the frame posts 26. A frame post plate 61 is affixed to the upper end 60 to provide additional support to the shell 54. More than two frame posts 26 may be used to provide additional structural support as shown in FIG. 5. Each of the frame posts 26 are aligned beneath one of the vertical support elements 58 to prevent the frame posts 26 from locally buckling the shell 54. Therefore, each vertical support element 58 will preferably also be spaced at least ten feet apart, but preferably not more than 20 feet apart. A lower end 52 of each frame post 26 is affixed to the base floor 28. Therefore, the support members 24 are supported above the base floor a length equal to the length of the frame posts 26 thereby providing space for the reclamation tanks 46 and related components beneath the paint application chamber 12.

Figure 7:
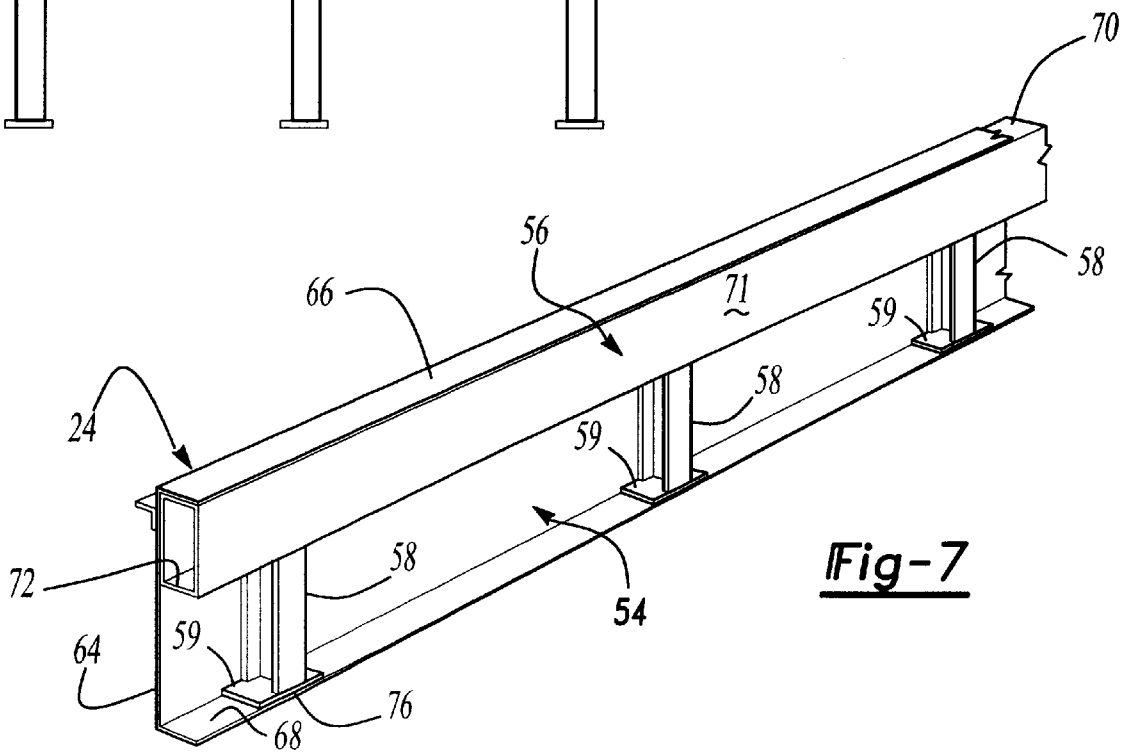
FIG. 7 is a perspective view of the support member of the subject invention.
Figure 6:
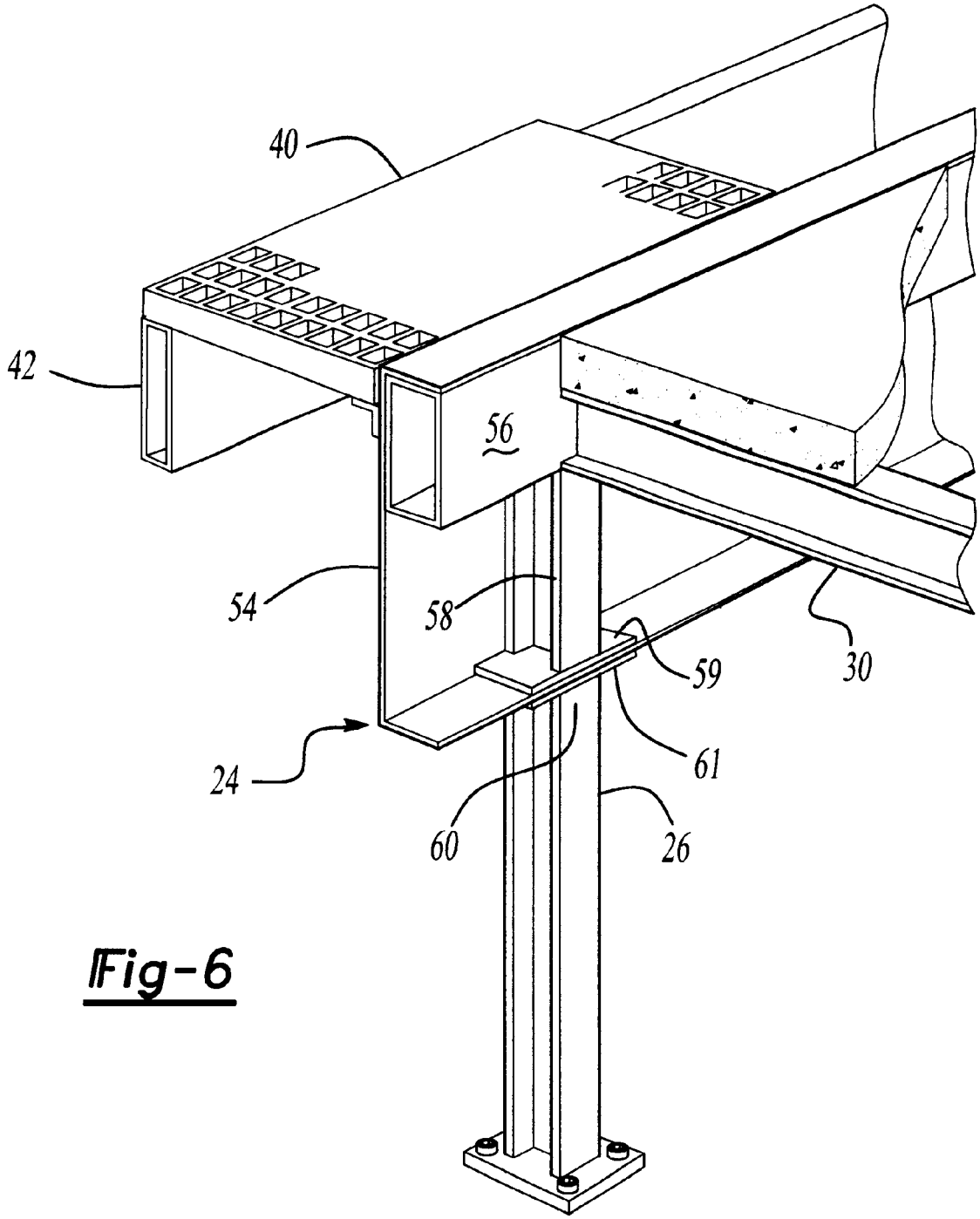
FIG. 6 is perspective view of section of the inventive frame assembly.

The building contractor installs each of the components that make up the frame 50. An important feature of the paint booth frame assembly of this invention is that the support members 24 may be pre-assembled and delivered to the building site ready to be mounted to the frame posts 26. FIG. 7 shows the support member 24 fully assembled as it is delivered to the building site. A grating shelf 62 for supporting one end of the grates 40 is optionally attached to the shell 54 prior to delivery to the building site. Alternatively, the grating shelf 62 can be attached at the building site.

Figure 4:
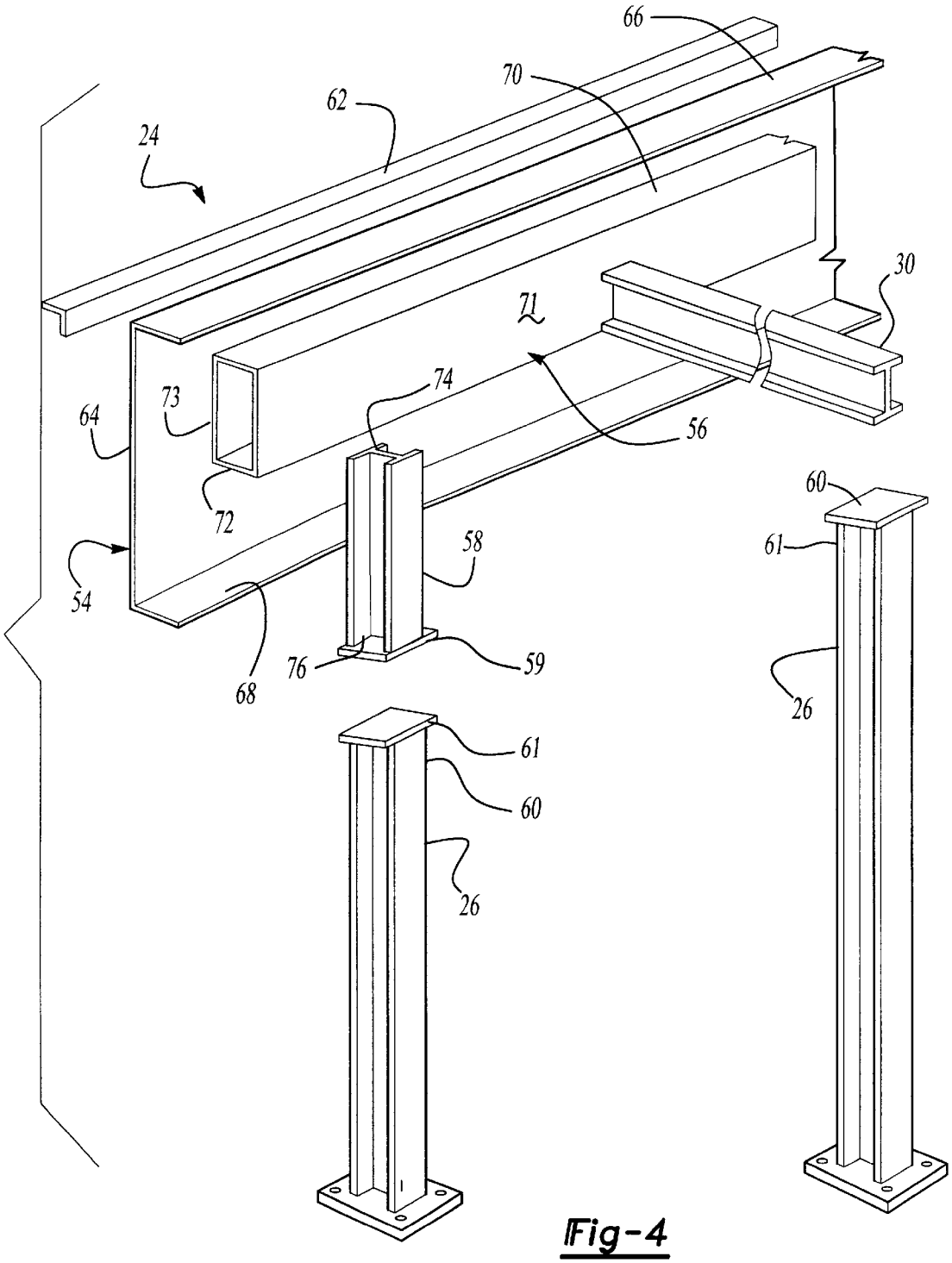
FIG. 4 is an exploded view of the inventive frame assembly.

The support members 24 thus may form a unitary truss assembly which can be preassembled at a convenient site remote from the construction site and delivered to the construction site as described above. The assembly of the unitary truss assembly 24 will now be described with reference to FIG. 4. The C-shaped shell or frame member 54 includes a central or mid-portion 64 and opposed leg portions 66 and 68 extending transverse to the mid portion. The structural element or beam 56 is preferably in the form of a rectangular tube having side faces 70 through 73. The vertical support elements or beams 58, such as I-beams, include end faces 74 and 76. The structural beam 56 is nested within the open side of the C-shaped frame member 54 with the end face 70 abutting the leg portion 66 and the side face 73 abutting the mid portion 64 of the C-shaped frame member and the abutting faces may be welded or otherwise secured. In the most preferred embodiment, the end faces 70 and 72 of the rectangular tubular beam are shorter than the side faces 71 and 73 providing greater structural support and the end face 72 is spaced from the leg portion 64 to received the spaced vertical support beams 58. The support beams are assembled in the C-shaped frame member, wherein one end abuts the lower end 72 of the tubular structural beam 56 and the other end abuts the opposed leg portion 68 of the C-shaped frame member 54. Again, the abutting surfaces of the support elements or beams 58 may be welded or otherwise secured to the C-shaped frame member 54 and the rectangular beam 56. As set forth above, the angle iron or grating shelf 62 may be welded to the mid portion 64 of the C-shaped frame member 54 at the building site or at the site where the unitary truss assembly 24 is assembled. The rectangular tubular beam 56 and support beams 58 may be formed of structural steel; however, where the elongated C-shaped frame member forms a wall of the reclamation tank 46, as described below, the C-shaped frame member 54 is preferably formed of stainless steel to prevent contamination of the paint. Where the unitary truss assembly 24 is manufactured at a remote site, the tubular structural element or beam 56 and the C-shaped shell or frame member 54 will have the same length and the vertical support elements or beams 58 will be spaced to provide support for the paint application booth as described below.

Each of the shells 54 forms a section or wall of one of the reclamation tanks 46. In a liquid paint application booth, only one reclamation tank may be utilized which spans the shells and may be supported on the floor 28. The shells 54 are preferably less than about forty feet in length. If the length exceeds forty feet, the support members 24 will be difficult to transport and install. As best shown in FIG. 1, the shells 54 form an upper wall of the tanks 46 or the single tank of a liquid paint booth, The shells 54 can range from one foot to six feet in width depending upon the type of reclamation tank 46 selected for the booth 10. A powder paint system would preferably utilize a shell 54 that is one and a half feet wide. A liquid paint system would preferably utilize a shell 54 that is five feet in width. In either case, the shells 54 are formed from stainless steel to provide the durability required of the paint booth 10. Because each shell 54 forms a section of the reclamation tanks 46, the tanks 46 can be installed after the completion of the building that houses the booth 10. The control room floor 32 can be also installed prior to installing the reclamation tanks 46.

Because the support beam 24 forms a section of the reclamation tanks 46 and provides structural support to the surrounding booth components, i.e. the horizontal support beams 30, the entirety of the booth 10 can be installed simultaneously after the building is completed. Therefore, the period of time required to complete the building and the booth 10 can be reduced by as much as two months or more. The building work crew no longer needs to wait for the reclamation tanks 46 to be installed. Further, the support member 24 comprises both part of the reclamation tank 46 and the frame 50. This provides the booth 10 with a base that is already leveled and structurally secured even if the tanks 46 have not yet been installed.

The invention has been described in an illustrative manner, and it is to be understood that the terminology which has been used is intended to be in the nature of words of description rather than of limitation.

As will be understood, modifications and variations of the present invention are possible in light of the above teachings. It is, therefore, to be understood that within the scope of the appended claims, wherein, for example, the box beam 56 may be replaced with a conventional I-beam, reference numerals are merely for convenience and are not to be in any way limiting, the invention may be practiced otherwise than as specifically described. Further, the columns 58, 26 may be replaced with a single column and the lower flange 68 may be notched to accommodate a single column.

What is claimed is:

1. A method of constructing building that houses a paint booth for painting products comprising the following steps performed in sequence:

providing a support member having a horizontal structural element disposed within a shell;

affixing a plurality of frame posts to a base in an upright position;

supporting a plurality of said shells arranged in opposing columns each with at least two of said frame posts;

affixing a plurality of horizontal support beams between said plurality of horizontal structural elements and one of said frame posts spaced outwardly of said support members;

constructing a building to house said paint booth; and attaching a paint reclamation tank to at least one shell said shells subsequent to said step of constructing said building.

2. A method as set forth in claim 1 further including the step of forming a floor structure over said plurality of horizontal support beams.

3. A method as set forth in claim 2 further including the step of constructing a section of said paint booth over each of opposing said support members.

4. A method as set forth in claim 1 wherein said step of attaching said paint reclamation tank to said shell is further defined by forming a section of said reclamation tank from said shell.

5. A method as set forth in claim 1 further including the step of affixing a grating shelf to each of said shells.

6. A method as set forth in claim 1 further including the step of affixing a conveyor beam to each of said shells with at least two conveyor support beams.

7. A method as set forth in claim 6 further including the step of supporting said grating at a first end with said grating shelf and at a second end with said conveyor beam.

8. A method as set forth in claim 1 wherein said step of supporting a plurality of said shells with said frame posts is further defined by aligning said support beams beneath said vertical structural element disposed within said shells.

9. A method as set forth in claim 8 including the step of aligning one of said frame posts and one of said vertical structural element with a seam formed between adjacent of said support members.

10. A method as set forth in claim 1 including constructing a control room on either side of said paint booth over said floor.

11. A method as set forth in claim 10 further including the step of integrating an air supply plenum with said paint booth.

12. A method as set forth in claim 10 further including the step of forming said shell from stainless steel.

13. A frame assembly for supporting a paint booth having paint application chamber and a reclamation tank, said assembly comprising:

a plurality of frame posts having a lower end affixed to a base;

opposing shells arranged end to end in a parallel column, each shell being affixed to at least two of said frame posts;

a horizontal structural element affixed longitudinally inside said shell;

at least one vertical support element affixed to said horizontal structural element inside said shell;

each of said shells forming a section of said reclamation tank and providing structural support to a section of said paint application chamber.

14. An assembly as set forth in claim 13 further including a plurality horizontal support beams affixed to and extending outwardly from said horizontal structural element.

15. An assembly as set forth in claim 14 wherein said plurality of horizontal support beams provides support to a floor structure.

16. An assembly as set forth in claim 15 wherein each of said shells includes a grating shelve for supporting a plurality of said gratings.

17. An assembly as set forth in claim 16 further including opposing conveyor beams aligned substantially parallel between opposing of said shells.

18. An assembly as set forth in claim 17 further including at least two conveyor support beams affixed to said opposing shells for supporting one of said conveyor beams.

19. An assembly as set forth in claim 13 wherein said support beam comprises stainless steel.

20. A unitary truss assembly for use in constructing a paint booth of a paint application facility, comprising:

an elongated C-shaped frame member having a central portion and opposed leg portions extending generally perpendicular to said central portion;

an elongated rectangular beam nested within said C-shaped frame member having one side face abutting one of said leg portions of said C-shaped frame member and an adjacent side face abutting said central portion;

a plurality of spaced support beams each having one end face abutting a side face of said elongated rectangular beam opposite said one side face and an opposed end face abutting an opposed leg portion of said C-shaped frame member; and said elongated C-shaped frame member, said elongated rectangular beam and said support beams secured together as a unitary truss assembly prior to constructing said paint application facility.

21. The unitary truss assembly for use in constructing a paint booth of a paint application facility as defined in claim 20, wherein said unitary truss assembly is assembled and supported on vertical beams coaxially aligned with said support beams of said unitary truss assembly.

22. The unitary truss assembly for use in constructing a paint application booth of a paint application facility as defined in claim 21, wherein said paint booth includes a reclamation tank and said central portion of said C-shaped frame member forms a side wall of said reclamation tank.

23. The unitary truss assembly for use in constructing a paint booth of a paint application facility as defined in claim 21, wherein said paint application facility includes floor joists having an end face welded to a side face of said elongated rectangular beam opposite said adjacent side face.

24. The unitary truss assembly for use in constructing a paint booth of a paint application facility as defined in claim 20, wherein said abutting faces of said unitary truss assembly are welded together.

* * * * *